US009683324B2

(12) United States Patent
Marioni

(10) Patent No.: US 9,683,324 B2
(45) Date of Patent: Jun. 20, 2017

(54) FANS-MOTOR ASSEMBLY FOR CONDENSER LAUNDRY DRYER MACHINE AND CONDENSER LAUNDRY DRYER MACHINE COMPRISING SAID ASSEMBLY

(75) Inventor: Elio Marioni, Dueville (IT)

(73) Assignee: Askoll Holding S.r.l., Povolaro di Dueville (VI) (IT)

( * ) Notice: Subject to any disclaimer, the term of this patent is extended or adjusted under 35 U.S.C. 154(b) by 1091 days.

(21) Appl. No.: 13/050,279

(22) Filed: Mar. 17, 2011

(65) Prior Publication Data

US 2011/0225839 A1 Sep. 22, 2011

(30) Foreign Application Priority Data

Mar. 18, 2010 (EP) ..... 10425075

(51) Int. Cl.

*D06F 58/00* (2006.01)
*D06F 58/08* (2006.01)
*F04D 25/06* (2006.01)

(52) U.S. Cl.

CPC ..... *D06F 58/08* (2013.01); *F04D 25/0606* (2013.01)

(58) Field of Classification Search

CPC ..... H02K 1/2786; H02K 1/187; H02K 7/06; H02K 5/161; H02K 9/22; H02K 11/33; H02K 11/05; H02K 11/30; H02K 1/185; H02K 3/28; H02K 41/06; H02K 47/00; H02K 47/20; H02K 53/00; D06F 58/08; D06F 37/30

USPC ..... 310/254.1, 154.35, 154.38, 154.41, 310/154.43

See application file for complete search history.

(56) References Cited

U.S. PATENT DOCUMENTS

| | | | | |
|---|---|---|---|---|
| 4,006,535 | A * | 2/1977 | Nelson | 34/572 |
| 4,147,070 | A * | 4/1979 | McMillan | 474/134 |
| 6,081,058 | A * | 6/2000 | Suzuki et al. | 310/156.45 |
| 6,441,522 | B1 * | 8/2002 | Scott | 310/156.23 |
| 6,492,756 | B1 * | 12/2002 | Maslov et al. | 310/156.12 |
| 6,822,368 | B2 * | 11/2004 | Maslov et al. | 310/254.1 |
| 6,879,078 | B2 * | 4/2005 | Wolters | 310/216.074 |
| 2002/0158543 | A1 * | 10/2002 | Wolters | 310/254 |
| 2004/0021395 | A1 * | 2/2004 | Maslov et al. | 310/254 |
| 2004/0107562 | A1 * | 6/2004 | Wolters | 29/596 |
| 2004/0163428 | A1 * | 8/2004 | Kim et al. | 68/140 |
| 2005/0172510 | A1 * | 8/2005 | Cimetta et al. | 34/603 |

(Continued)

FOREIGN PATENT DOCUMENTS

| | | | |
|---|---|---|---|
| DE | 10202442 | A1 | 8/2003 |
| DE | 102008040704 | A1 | 1/2010 |

(Continued)

*Primary Examiner* — Jason Lau
(74) *Attorney, Agent, or Firm* — Akerman LLP

(57) ABSTRACT

A fans-motor assembly for condenser laundry dryer machine, of unusually low cost and overall dimensions, comprising: a drive shaft which can be associated in a rotating manner with a frame of a laundry dryer machine and designed to be connected by means of a transmission belt to a rotating drum thereof; a fan for the hot air and a fan for the cold air integral in rotation with said drive shaft and designed to convey respectively a flow of hot air and a flow of cold air along separate paths of said laundry dryer machine; a synchronous permanent magnet electric motor comprising an internal stator traversed by said drive shaft and an external rotor integral during rotation with said drive shaft.

15 Claims, 5 Drawing Sheets

(56) References Cited

U.S. PATENT DOCUMENTS

| | | | | |
|---|---|---|---|---|
| 2006/0119204 | A1* | 6/2006 | Awazu et al. | 310/156.53 |
| 2006/0208604 | A1* | 9/2006 | Marioni | H02K 7/086 310/261.1 |
| 2007/0046123 | A1* | 3/2007 | Marioni | 310/156.26 |
| 2007/0063595 | A1* | 3/2007 | Habibi et al. | 310/67 A |
| 2008/0184585 | A1* | 8/2008 | Yoo et al. | 34/427 |
| 2008/0278019 | A1* | 11/2008 | Lu et al. | 310/156.32 |
| 2009/0009010 | A1* | 1/2009 | Chung et al. | 310/46 |

FOREIGN PATENT DOCUMENTS

| | | | |
|---|---|---|---|
| EP | 0328250 | A1 | 8/1989 |
| EP | 0434169 | A2 | 6/1991 |
| EP | 1541744 | A1 | 6/2005 |

* cited by examiner

FANS-MOTOR ASSEMBLY FOR CONDENSER LAUNDRY DRYER MACHINE AND CONDENSER LAUNDRY DRYER MACHINE COMPRISING SAID ASSEMBLY

CROSS-REFERENCE TO RELATED APPLICATIONS

The present application claims priority to European Patent Application No. 10425075.8, filed Mar. 18, 2010, the entirety of which is incorporated herein by reference.

FIELD OF APPLICATION

The present invention relates, in its more general aspect, to an assembly comprising the motor and the fans which determine the functioning of a laundry dryer machine.

The technical field of the invention therefore relates to laundry dryer machines, and more particularly the specific field of laundry dryer machines of the condenser type.

It should be noted that the generic term laundry dryer used in the present description is to comprise also machines which, in addition to the drying function, also integrate a function of washing of laundry.

PRIOR ART

Laundry dryer machines of various kinds and types are used both in the home and in industry to remove the moisture from items of clothing and/or other textile products, usually following a cycle of washing performed thereon.

In a traditional embodiment said laundry washing machines have a rotating drum intended to hold the laundry to be dried. The machine also comprises a system of ventilation and heating which takes in air from the outside and feeds it, heated, into said rotating drum. The hot air promotes the evaporation of the moisture contained in the laundry and becomes saturated therewith. The resulting moist air is then expelled into the outside environment by the system of ventilation.

Laundry washing machines of this type have however a limited thermal efficiency and also contribute to raising the degree of humidity of the area in which they are installed.

To avoid these disadvantages laundry washing machines of the so-called condenser type have been introduced onto the market. Said machines function in a manner substantially similar to traditional machines, yet differ from them in that the hot air used to dry the laundry is not expelled to the exterior of the machine, but instead dehumidified and then made to recirculate towards the rotating drum.

In the simpler models of condenser laundry washing machine the operation of dehumidification is obtained by means of a cross flow heat exchanger. The heat exchange takes place between the flow of hot drying air and a flow of cold air coming from the outside and then expelled at the outlet from the exchanger, according to the diagram of operation that can be seen in FIG. 1.

Said laundry washing machines therefore comprise at least three motorised components: the rotating drum and the two fans which move the flow of hot and cold air in respective conduits.

According to a criterion of constructional simplicity and economy, use of a single electric motor for the motorisation of the three aforementioned components is appropriate.

More particularly it is especially advantageous to fit the two fans at the opposite ends of a single drive shaft, whereto the rotating drum is also connected by means of a belt transmission. The drive shaft is integral with the rotor of an electric motor of the asynchronous type supported by the frame of the laundry dryer machine. Said electric motor is therefore positioned in a central position in relation to the drive shaft and completely traversed thereby.

The motor, the shaft and the fans therefore form a fans-motor assembly which is particularly compact and with a simple structure.

The fans-motor assembly described above, although substantially meeting market demands, nevertheless has some disadvantages.

More particularly, the limited diameter of the rotor produces a motor with relatively low torque density. To obtain therefore the torque necessary for rotating the drum of the machine it is necessary to provide a motor of large dimensions.

It should be noted in this respect that the maximum transmission ratio which can be obtained between drive shaft and drum is univocally determined by the diameter of the two members connected with belt, unless mechanical means are inserted for the variation of the transmission ratio which would affect the overall cost of the application.

The dimensions of the electric motor mean above all a high cost, due to the need to use a high quantity of active materials.

Moreover, the overall dimensions of the motor determine constructional compromises which reduce the overall efficiency of the laundry dryer machine. For example, the pulley which tightens the transmission belt has to be formed on the casing of the stator, the reason why the entire stator has to be mounted rotatingly on the frame of the machine by means of bushings. Given however the considerable weight of the stator casing, the bushings whereon it is mounted tend to wear rapidly, requiring inconvenient operations of maintenance.

It should be noted also that, again due to the overall dimensions of the motor, it cannot be directly associated with a control board, which should be installed in another position of the machine and then connected to the motor itself by means of costly cablings, which can moreover be damaged causing breakdowns.

The technical problem at the basis of the present invention is therefore that of devising a fans-motor assembly which allows the disadvantages of the prior art described to be resolved, and more particularly which allows the production costs to be limited while meeting the torque requirements necessary for rotating the drum of the laundry dryer machine.

SUMMARY OF THE INVENTION

The aforementioned technical problem is resolved by a fans-motor assembly for laundry dryer machine comprising: a drive shaft which can be associated in a rotating manner with a frame of a laundry dryer machine and designed to be connected via a transmission belt to a rotating drum thereof; a fan for the hot air and a fan for the cold air integral during rotation with said drive shaft and designed to convey respectively a flow of drying air and a flow of cooling air along separate paths of said laundry dryer machine; a permanent magnet electric motor, preferably synchronous, comprising an internal stator traversed by said drive shaft and an external rotor integral during rotation with said drive shaft and designed to move it to rotate.

The use of a synchronous permanent magnet electric motor in place of the asynchronous motor universally used in the prior art allows the rotor which drives the drive shaft to be brought to the exterior, increasing the arm which separates the axis of rotation from the air gap and consequently obtaining greater torque density. In this way it is possible to limit considerably the production costs and the overall dimensions of the electric motor while observing the torque conditions necessary for ensuring the rotation of the rotating drum in normal load conditions.

The space freed by the overall dimension of the electric motor can be advantageously used for housing other mechanical and electronic components in the fans-motor assembly. For example, the assembly can comprise a belt tightener constituting support for the internal stator of the electric motor. More particularly, said internal stator can be integrally fitted on a portion of said belt tightener.

The belt tightener will therefore be mounted, rotating, on the frame of the laundry dryer machine, for example by means of one or more bushings, in such a way as to be oscillating in relation thereto allowing the tightening of the belt.

In a particularly advantageous embodiment, said belt tightener may comprise a sleeve rotatingly coupled with an intermediate portion of the drive shaft, said internal stator being supported by said sleeve.

The belt tightener, in one of its particularly simple and functional forms, may comprise an oscillating lever integral with the sleeve and holding at one end an idle pulley for the tightening of the transmission belt. The other end of the lever can be connected to the frame of the laundry dryer machine via appropriate elastic means: for example a helical spring, or a deformable member restrained to the fixed structure of the appliance. In this case the sleeve is associated rotatingly with the frame of the laundry dryer machine so as to define the fulcrum of the aforementioned lever. The elastic means maintain under tension the transmission belt of the machine. It should be noted that, the stator of the electric motor being integral with the belt tightener, according to the direction of rotation the motor can contribute to the tightening of the belt or, on the contrary, oppose the action of the elastic means.

It should be noted that the lever can be made in one piece with the sleeve, for example in plastic material by means of a single operation of moulding.

The sleeve, which as previously mentioned is free to rotate in relation to the frame of the laundry dryer machine, under the opposing action of the tightness of the belt and of the elastic means and of the electric motor, during functioning of the machine stabilises in a position of equilibrium of said forces. Consequently it can support the rotating drive shaft which traverses it. More particularly, between the sleeve and the drive shaft rotatingly coupled therewith at least two ball bearings can be interposed, preferably positioned at the opposite ends of the same sleeve.

The internal stator may comprise a lamination pack in ferromagnetic material which has an annular core wherefrom a plurality of arms branch off in a radial pattern, said arms being covered by reels, electrical windings being positioned over said reels.

The aforementioned annular core can be mounted on the sleeve through the coupling of grooved profiles.

The reels may comprise, at the their end turned towards the exterior of the radial pattern, flanges designed to attach ferromagnetic inserts which act as pole pieces of the magnetic circuit defined by the lamination pack. In this way said flanges can advantageously define a continuous annular belt wherein the ferromagnetic inserts are set. The continuity of said annular belt ensures a constant air gap between it and the permanent magnet of the rotor, contributing to the low noise levels of the electric motor.

Moreover the fans-motor assembly according to the present invention may comprise at least one control board of the electric motor integral with the internal stator. Said board can be mounted directly on the stator, even inside the same casing which encloses the active parts thereof. This embodiment allows the avoiding of the connection of the board to the motor by means of costly cablings which are difficult to install.

The control board may comprise connection means, made for example in the form of female electrical connectors, for power supply and/or signal cables. These connection means can be accessible from the exterior of the casing by means of apertures thereof, thus allowing a rapid connection of the device to the electrical circuit of the laundry dryer machine, for example via the simple insertion of the plugs of the cables inside the connectors.

The external rotor may comprise a container cup which embraces the external periphery of the internal stator. Said container cup can have a cylindrical internal surface whereto a metal ring, also cylindrical, is coupled, which in turn supports an annular permanent magnet. This configuration allows the container cup in plastic material to be produced via a normal moulding operation.

The technical problem defined above is also resolved by a laundry dryer machine comprising: a rotating drum, rotatingly mounted in relation to a frame and intended to hold laundry to be dried, a path of the hot air which traverses said rotating drum and a first side of a heat exchanger and a path of the cold air which traverses the second side of said heat exchanger, said laundry dryer machine comprising also a fans-motor assembly according to any one of the previous embodiments.

DETAILED DESCRIPTION

Referring to the accompanying drawings, 1 denotes generically the motor-bushings assembly of a laundry dryer machine 102 of the condenser type.

Figure 1:
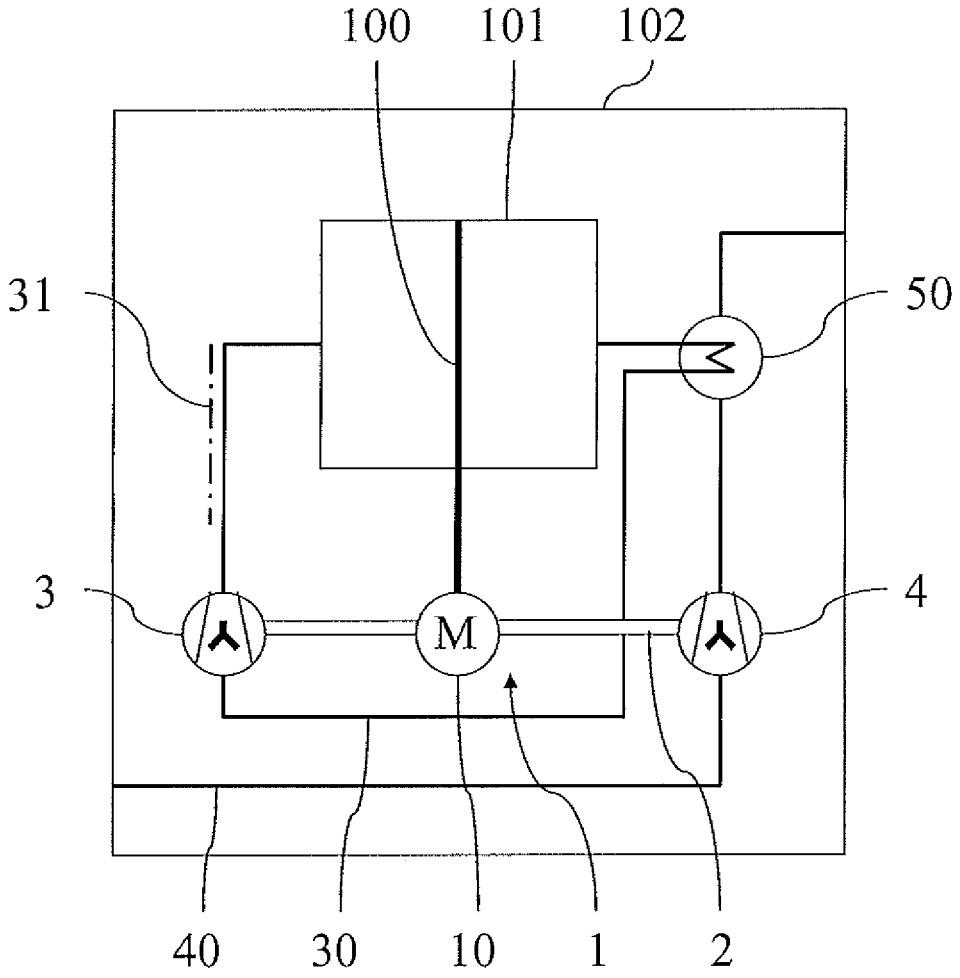
FIG. 1 shows, schematically, a condenser laundry dryer machine according to the present invention.
Figure 2:
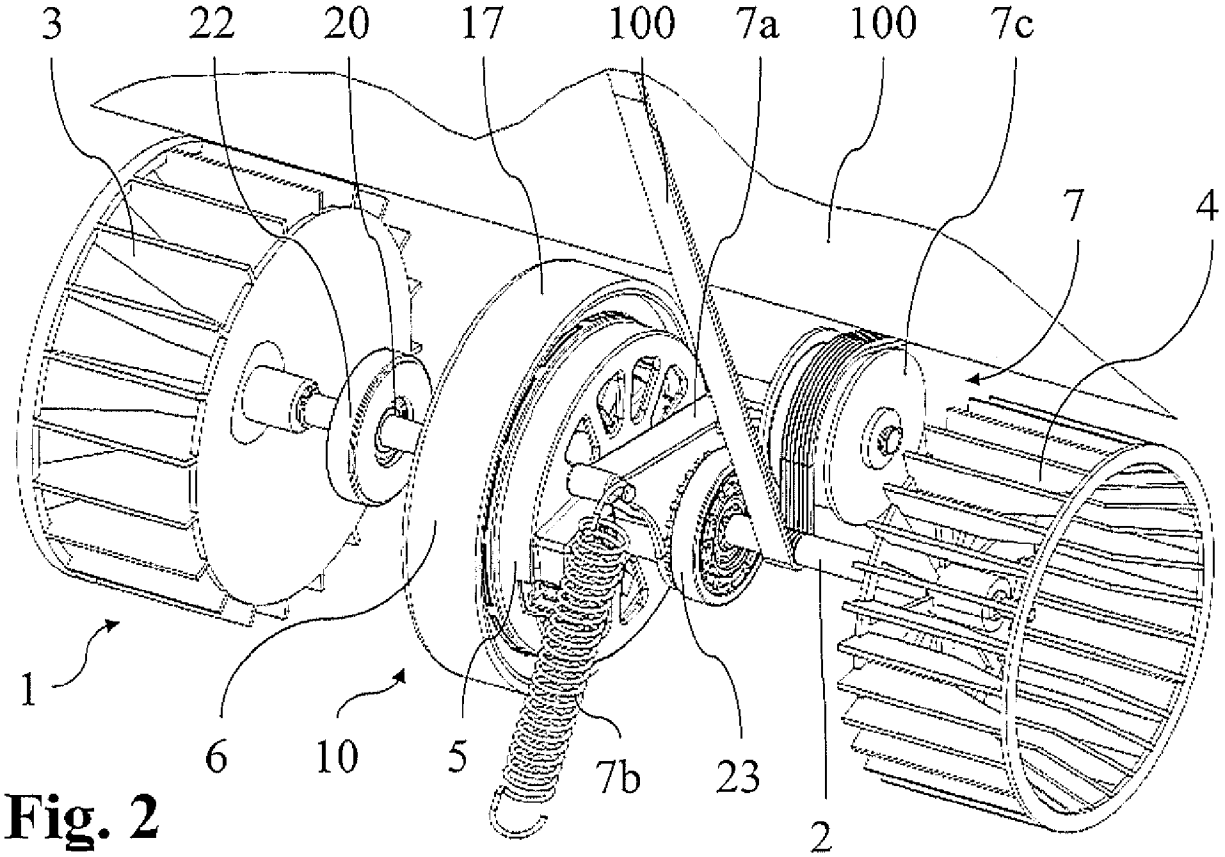
FIG. 2 shows a perspective view of a fans-motor assembly according to the present invention connected to a rotating drum by means of a transmission belt.
Figure 3:
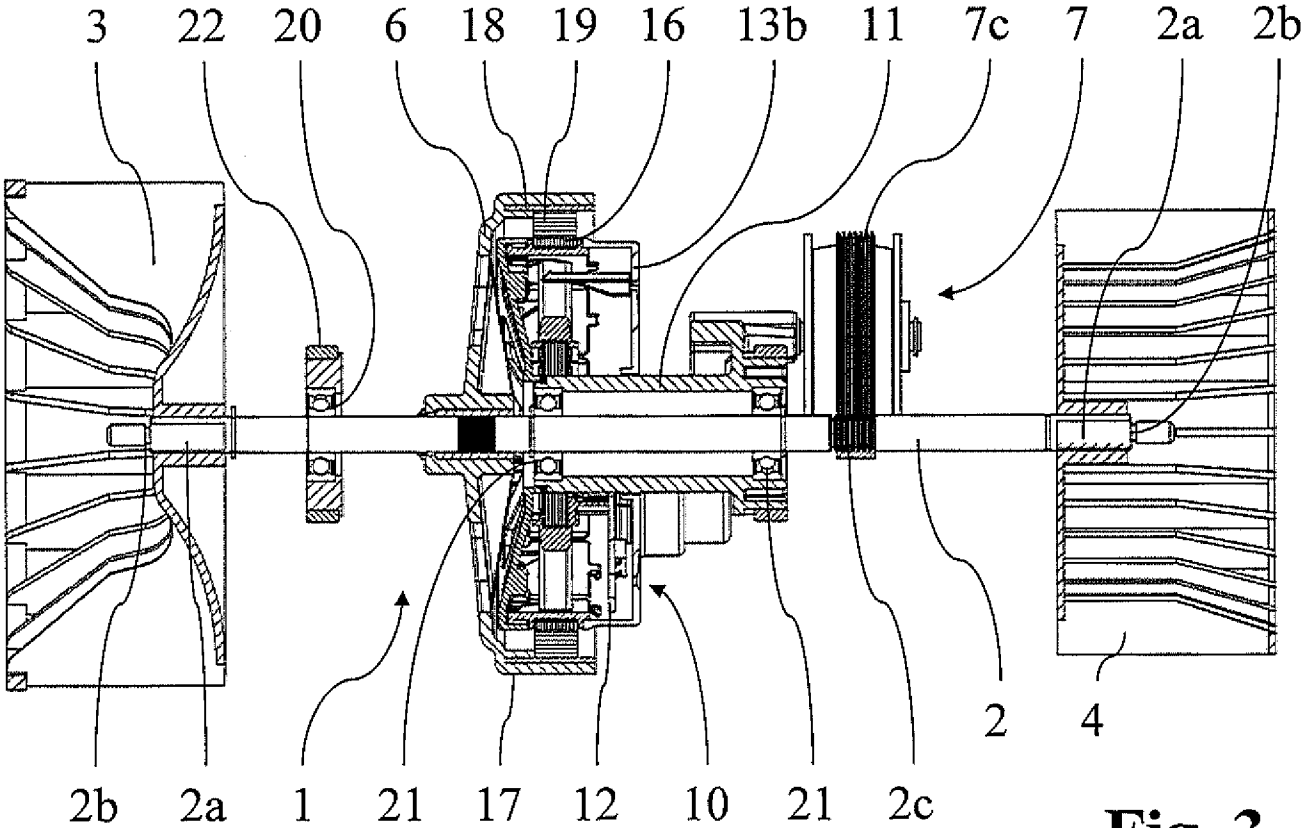
FIG. 3 shows a front view sectioned along a vertical median plane of the fans-motor assembly of FIG. 2.
Figure 4:
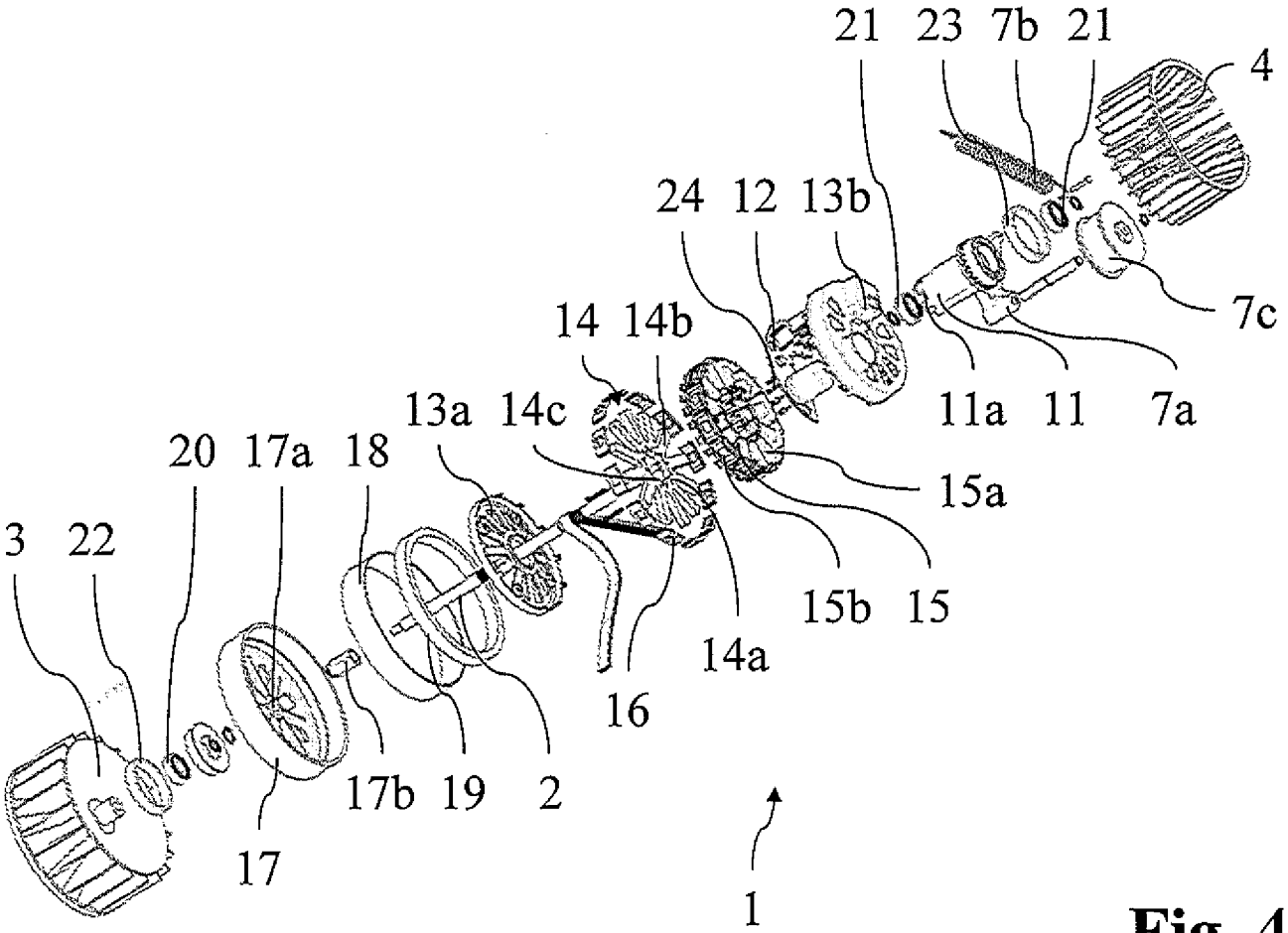
FIG. 4 shows a perspective view with blown-up parts of the fans-motor assembly of FIG. 2.
Figure 5:
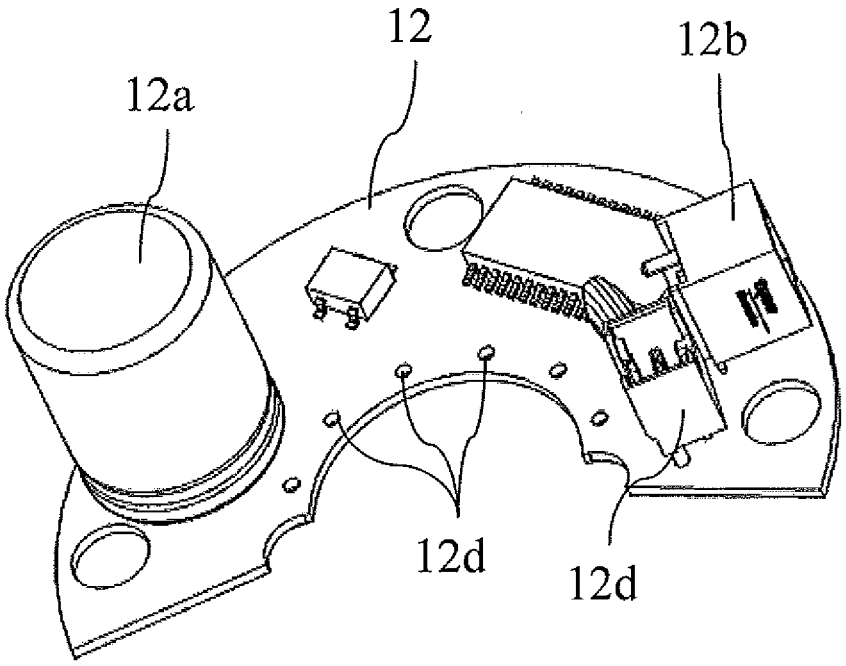
FIG. 5 shows a perspective view of a control board forming part of the fans-motor assembly of FIG. 2.

The known principle of operation of the condenser laundry dryer machine 102 can be seen from the constructional diagram shown in FIG. 1.

It comprises a rotating drum 101, rotatingly mounted in relation to a frame of the machine, intended to hold a load of laundry to be dried.

Inside the laundry dryer machine 102 a path of the hot air 30 and a path of the cold air 40 are defined, along which a fan for the hot air 3 and a fan for the cold air 4 are positioned respectively.

During operation of the appliance, the rotating drum 101 is maintained in rotation by means of an electric motor 10.

In the meantime, the fan for the hot air 3 maintains in circulation a flow of drying air via the path of the hot air 30. Said drying air is heated by means of appropriate heating means 31, and is then blown inside the rotating drum 101 where it contributes to the evaporation of the water contained in the load of laundry, saturating with moisture. Exiting from the drum, the air is conveyed towards a first side of a cross flow heat exchanger 50 in which it is dehumidified, to then recirculate along the path described.

In the meantime, the fan for the cold air 4 conveys a flow of cooling air coming from the exterior of the laundry dryer machine 102 via the path of the cold air. Said external air flow traverses the second side of the cross flow heat exchanger 50, promoting the condensation of the water contained in the flow of drying air, to then be expelled outside of the laundry dryer machine 102.

The condensed moisture inside the heat exchanger 50 can be collected in an appropriate recovery basin or evacuated by means of a discharge pump.

The motor-bushings assembly 1 comprises a drive shaft 2, rotatingly associated with the frame of the laundry dryer machine 102, the aforementioned fans for the hot air 3 and for the cold air 4 and the electric motor 10, intended to drive the drive shaft 2 in rotation. Appropriately in fact, said motor members are integrated in a single mechanical assembly mounted inside the frame of the laundry dryer machine 102.

The electric motor 10 is a synchronous permanent magnet electric motor comprising an internal stator 5 rotatingly traversed by the drive shaft 2 and an external rotor 6 which instead is integral during rotation with the shaft. Said motor is positioned at an intermediate section of the drive shaft 2.

The two fans 3, 4, of a known type, are instead keyed to the opposite ends of the drive shaft 2 so as to rotate integrally with the shaft during the functioning of the electric motor 10.

More particularly, the two ends of the drive shaft 2 have a flat face 2*a* formed on the cylindrical profile, which allows the coupling with the hub of the two fans shaped correspondingly. At both the ends there is also an attachment groove 2*b* for the insertion of an elastic ring for stopping the respective fan.

As can be seen from the description of the general principles of operation of the laundry dryer machine 102, the fan for the hot air 3 and the fan for the cold air 4 must be positioned along two separate paths, respectively the path of the hot air 30 and the path of the cold air 40, which define the two sides of the cross flow heat exchanger 50. Consequently, the drive shaft 2, when mounted on the laundry dryer machine, has to traverse at least one septum of separation, which cannot be seen in the accompanying drawings and which divides the two paths. The opposite ends of the drive shaft 2, whereon the fan for the hot air 3 and the fan for the cold air 4 are keyed, are thus respectively contained within the path of the hot air 30 and within the path of the cold air 40.

In the embodiment described here, the septum of separation divides the drive shaft 2 into a first portion, whereon the fan for the hot air 3 is mounted, and a second portion, whereon the electric motor 10 acts and the fan for the cold air 4 is mounted.

The drive shaft 2 exhibits, between the electric motor 10 and the fan for the cold air 4, a plurality of transmission grooves 2*c* for the holding of a striated transmission belt 100 designed to transmit the motion of the drive shaft 2 to the rotating drum 101. Naturally alternative embodiments could provide other means of connection of the transmission belt 100 to the drive shaft 2, such as for example a pulley.

The drive shaft 2, when mounted on the laundry dryer machine 102, is supported by the frame thereof in two separate points. On one side, in proximity of the fan for the hot air 3, it is supported by a first ball bearing 20, whereto a vibration prevention ring 22 in rubber is coupled externally and integrally associated in a through hole of the septum of separation previously mentioned.

On the opposite side, the drive shaft 2 traverses a sleeve 11 which supports it by means of two second ball bearings 21 mounted in its interior, at its ends. The sleeve 11 is in turn rotatingly associated with the frame of the laundry dryer machine 102 by means of a bushing 23, according to methods described herein below.

The sleeve 11 is comprised in a belt tightener 7 designed to deviate the transmission belt 100 so as to make it embrace a larger arc of the periphery of the drive shaft 2.

The belt tightener 7 comprises a lever 7*a*, integral with the sleeve 11 and made in one part with it, a pulley 7*c* mounted idly at the end of one of the arms of said lever 7*a*, and a helical spring 7*b* designed to connect the other arm of the lever 7*a* at a point integral with the frame of the laundry dryer machine 102. The sleeve 11 is rotatingly mounted, along the axis of rotation of the drive shaft 2, on the frame of the laundry dryer machine 102 so that the belt tightener 7 can oscillate in relation to said frame. The rotating mounting is ensured by the aforementioned bushing 23, associated with the external periphery of the end of the sleeve 11 turned towards the fan for the cold air 4. Said bushing 23, inserted with the possibility of rotating inside a circular seat integral with the frame of the laundry dryer machine 102, is made in rubber and also performs a function of damping of the vibrations produced by the fans-motor assembly 1.

It should be noted that the lever 7*c* is positioned at the end of the sleeve 11 turned towards the fan for the cold air 4, and that the pulley 7*c* is mounted projecting in relation to the lever 7*a*, again turned towards said fan. In this way the pulley 7*c* is positioned, in relation to the drive shaft 2, in an axial position corresponding to that of the transmission grooves 2*c*.

The internal stator 5 of the electric motor is mounted on the external periphery of the sleeve 11, at the end opposite the one where the lever 7*a* is positioned.

The belt tightener 7 is therefore integral with the internal stator 5 and performs a function of support in respect thereof. The torque generated by the electric motor 10 on the one hand causes the rotation of the drive shaft 2 which, as specified herein below, is integral with it, and on the other hand influences the equilibrium of the forces acting on the belt tightener 7.

In fact, according to the direction of rotation, the electric motor 10 adds to or subtracts its action from that of the helical spring 7*b*, which must therefore be dimensioned to maintain the transmission belt 100 tight in both the working conditions.

Said internal stator 5 comprises a lamination pack 14 in ferromagnetic material which has an annular core 14*a* wherefrom twelve arms 14*b* branch off in a radial pattern and with square section which define the magnetic poles of stator.

To allow the coupling of the lamination pack 14 on the sleeve 11, the latter has a grooved external peripheral profile 11*a* at one of its ends, which associates with a corresponding grooved internal peripheral profile 14*c* of the annular core 14*a*.

The arms 14*b* of the annular core are inserted inside reels 15, above which the electrical windings 15*a* of the stator are positioned. Said reels 15 comprise, at their end turned towards the exterior of the radial pattern, flanges 15*b* designed to attach ferromagnetic inserts 16 which act as pole pieces of the magnetic circuit defined by the lamination pack 14.

The flanges 15*b* define a continuous annular belt wherein the ferromagnetic inserts 16 are set.

Said annular belt borders radially the internal stator 5; the stator comprises also a first half-shell 13*a* and a second half-shell 13*b* which border it axially. The first half-shell 13*a* is turned towards the fan for the hot air 3 or towards the external rotor 6, while the second half-shell 13*b* is turned to the opposite side. Said half-shells 13*a* and 13*b*, cup shaped, are associated by means of appropriate attachment means with the aforementioned annular belt.

The active parts of the stator, or the lamination pack 14 and the windings 15*a* mounted on the reels 15, are therefore enclosed in an casing 13 comprising the two half-shells 13*a*, 13*b* and the annular belt defined by the flanges 15*b*. Said half-shells 13*a*, 13*b* comprise appropriate apertures of lightening and aeration.

The electric motor 10 comprises a control board 12, which is also enclosed inside the casing 13 of the internal stator. More particularly, the control board 12 is inserted between the first half-shell and the radial pattern of reels 15.

The control board 12 is shaped like a circular crown sector so as to be able to adapt to the geometry of the internal stator 5. It is electrically connected to the windings 15*a* with conductor points 24 engaged in appropriate seats of the reels 15 and which traverse holes 12*d* of the same board.

Mounted on the control board 12, between the various electronic components necessary for the control of the operation of the synchronous electric motor 10, are a start capacitor 12*a* and two female connectors for power supply cable 12*b* and signal cable 12*c*. The first half-shell 13*a* has appropriate apertures intended to allow the projecting of the start capacitor 12*a* outside of the casing 13 and the access from the outside to the connectors 12*b*, 12*c*.

The external rotor 6 of the electric motor 10 is integrally associated with the drive shaft 2 in proximity of the end of the sleeve 11 whereon the internal stator 5 is mounted.

This external rotor 6 comprises a container cup 17 which embraces the external periphery of the internal stator 5. This container cup 17 has a central coupling hole 17*a* with prismatic section, intended to couple with the external profile, also prismatic, of an insert 17*b* which can be screwed integrally above a portion of the drive shaft 2. The container cup 17 has along its radial extension apertures of lightening and aeration.

The axial portion of the container cup 17 has a cylindrical internal surface 17*c* whereto a cylindrical metal ring 18 is coupled, which supports in turn an annular permanent magnet 19.

Said annular permanent magnet 19 faces onto the ferromagnetic inserts 16 which constitute the pole pieces of the internal stator 5, and is separated from these by an air gap of appropriate breadth.

Obviously a person skilled in the art may make numerous changes and modifications to the mechanical assembly and to the appliance described above, with the aim of meeting contingent and specific needs, all however contained within the sphere of protection of the invention as defined by the following claims.

The invention claimed is:

1. A fans-motor assembly for condenser laundry dryer machine, comprising:

a drive shaft, extending along a longitudinal axis, which can be associated in a rotating manner with a frame of a laundry dryer machine and designed to be connected by means of a transmission belt to a rotating drum thereof;

a fan for hot air and a fan for cold air integral in rotation with said drive shaft and designed to convey respectively a flow of drying air and a flow of cooling air along separate paths of said laundry dryer machine;

a permanent magnet electric motor associated with said drive shaft and designed to move said drive shaft to rotate, comprising:

an internal stator traversed by said drive shaft, said drive shaft being free to rotate within said internal stator; and an external rotor integral with said drive shaft;

a belt tightener comprising:

a bellcrank lever, distinct from the internal stator, lying on a plane transverse to said longitudinal axis and pivoting about said longitudinal axis, said bellcrank lever having two ends, a first end holding an axle with an idle pulley for the tightening of the transmission belt, a second end being configured to be connected to the frame of the laundry dryer machine via at least an elastic element; and a sleeve that can be associated in a rotating manner with the frame of the laundry dryer machine, said sleeve being rotatingly coupled on an intermediate portion of the drive shaft by means of at least two interposed ball bearings, said sleeve comprising:

a first portion supporting the internal stator; and a second portion supporting the bellcrank lever;

wherein said bellcrank lever is made in one part with the sleeve.

2. The fans-motor assembly according to claim 1, wherein said internal stator comprises a lamination pack in ferromagnetic material, said lamination pack having an annular core wherefrom a plurality of arms branch off in a radial pattern, said arms being covered by reels, electrical windings being positioned above said reels.

3. The fans-motor assembly according to claim 2, wherein said reels comprise, at their end turned towards the exterior of the radial pattern, flanges designed to attach ferromagnetic inserts which act as pole pieces of the magnetic circuit defined by the lamination pack.

4. The fans-motor assembly according to claim 3, wherein said flanges define a continuous annular belt wherein the ferromagnetic inserts are set.

5. The fans-motor assembly according to claim 1, also comprising at least one control board of the electric motor integral with the internal stator.

6. The fans-motor assembly according to claim 5, wherein said internal stator comprises a casing which encloses, in addition to the active parts of said internal stator, said control board.

7. The fans-motor assembly according to claim 6, wherein said control board comprises connection means for power supply and/or signal cables, said connection means being accessible from the exterior of the casing by means of apertures thereof.

8. The fans-motor assembly according to claim 1, wherein said external rotor comprises a container cup which embraces the external periphery of the internal stator.

9. The fans-motor assembly according to claim 8, wherein said container cup has a cylindrical internal surface whereto a cylindrical metal ring is coupled, which supports in turn an annular permanent magnet.

10. A condenser laundry dryer machine comprising:

a rotating drum, rotatingly mounted in relation to a frame and intended to hold laundry to be dried;

a path of the hot air which traverses said rotating drum and a first side of a heat exchanger; and a path of the cold air which traverses the second side of said heat exchanger, said laundry dryer machine comprising a fans-motor assembly according to claim 1.

11. A fans-motor assembly for condenser laundry dryer machine, comprising:

a drive shaft, extending along a longitudinal axis, which can be associated in a rotating manner with a frame of a laundry dryer machine and designed to be connected by means of a transmission belt to a rotating drum thereof;

a fan for hot air and a fan for cold air integral in rotation with said drive shaft and designed to convey respectively a flow of drying air and a flow of cooling air along separate paths of said laundry dryer machine;

a permanent magnet electric motor associated with said drive shaft and designed to move said drive shaft to rotate, comprising:

an internal stator traversed by said drive shaft, said drive shaft being free to rotate within said internal stator; and an external rotor integral with said drive shaft;

a belt tightener comprising:

a bellcrank lever, distinct from the internal stator, lying on a plane transverse to said longitudinal axis and pivoting about said longitudinal axis, said bellcrank lever having two ends, a first end holding an axle with an idle pulley for the tightening of the transmission belt, a second end being configured to be connected to the frame of the laundry dryer machine via at least an elastic element; and a sleeve that can be associated in a rotating manner with the frame of the laundry dryer machine, said sleeve being rotatingly coupled on an intermediate portion of the drive shaft by means of at least two interposed ball bearings, said sleeve comprising:

a first portion supporting the internal stator; and a second portion supporting the bellcrank lever;

wherein said sleeve has a first end and a second end opposite to said first end, said bellcrank lever being at the first end of said sleeve, said internal stator being solidly supported over and around an external surface of said sleeve at said second end of the sleeve.

12. The fans-motor assembly according to claim 1, wherein said drive shaft is configured to receive said transmission belt in a belt receiving position which is axially offset with respect to said sleeve, said idle pulley being axially offset with respect to said sleeve and being aligned with said belt receiving position on said drive shaft.

13. A fans-motor assembly according to claim 1, further comprising a first bearing and a second bearing configured to be mounted on a frame of a laundry dryer machine in order to support the rest of the fans-motor assembly, the first bearing being directly supported by a portion of the drive shaft, the second bearing being supported by the second portion of the sleeve.

14. A fans-motor assembly for condenser laundry dryer machine, comprising:

a drive shaft, extending along a longitudinal axis, which can be associated in a rotating manner with a frame of a laundry dryer machine and designed to be connected by means of a transmission belt to a rotating drum thereof;

a fan for hot air and a fan for cold air integral in rotation with said drive shaft and designed to convey respectively a flow of drying air and a flow of cooling air along separate paths of said laundry dryer machine;

a permanent magnet electric motor associated with said drive shaft and designed to move said drive shaft to rotate, comprising:

an internal stator traversed by said drive shaft, said drive shaft being free to rotate within said internal stator; and an external rotor integral with said drive shaft;

a belt tightener comprising:

a bellcrank lever, distinct from the internal stator, lying on a plane transverse to said longitudinal axis and pivoting about said longitudinal axis, said bellcrank lever having two ends, a first end holding an axle with an idle pulley for the tightening of the transmission belt, a second end being configured to be connected to the frame of the laundry dryer machine via at least an elastic element; and a sleeve that can be associated in a rotating manner with the frame of the laundry dryer machine, said sleeve being rotatingly coupled on an intermediate portion of the drive shaft by means of at least two interposed ball bearings, said sleeve comprising:

a first portion supporting the internal stator; and a second portion supporting the bellcrank lever;

wherein said bellcrank lever is spaced apart and axially offset from said internal stator, said sleeve further comprising an intermediate spacer portion between said first portion and said second portion.

15. A fans-motor assembly according to claim 1, wherein said bellcrank lever has a substantially triangular shape.

* * * * *